US009841262B2

(12) United States Patent
Maclean

(10) Patent No.: US 9,841,262 B2
(45) Date of Patent: Dec. 12, 2017

(54) LINKED ROUND CARRYING BAG

(71) Applicant: Robert Frank Maclean, Leicester (GB)

(72) Inventor: Robert Frank Maclean, Leicester (GB)

( * ) Notice: Subject to any disclaimer, the term of this patent is extended or adjusted under 35 U.S.C. 154(b) by 0 days.

(21) Appl. No.: 15/121,105

(22) PCT Filed: Feb. 12, 2015

(86) PCT No.: PCT/GB2015/050386
§ 371 (c)(1),
(2) Date: Aug. 24, 2016

(87) PCT Pub. No.: WO2015/128607
PCT Pub. Date: Sep. 3, 2015

(65) Prior Publication Data

US 2017/0059292 A1 Mar. 2, 2017

(30) Foreign Application Priority Data

Feb. 27, 2014 (GB) ..... 1403433.4

(51) Int. Cl.
*F42B 39/02* (2006.01)
*F41A 9/79* (2006.01)
*F42B 39/00* (2006.01)

(52) U.S. Cl.
CPC ..... *F42B 39/02* (2013.01); *F41A 9/79* (2013.01); *F42B 39/00* (2013.01)

(58) Field of Classification Search
CPC .. F42B 39/02; F42B 39/00; F41A 9/79; F41A 9/80; F41A 9/81
USPC ..... 89/33.14
See application file for complete search history.

(56) References Cited

U.S. PATENT DOCUMENTS 1,213,755 A * 1/1917 Davies ..... B65D 85/12 206/3
1,781,816 A * 11/1930 Jovino ..... F42B 39/02 224/223
2,455,352 A * 12/1948 Beckman ..... F42B 39/02 224/602
2,763,411 A * 9/1956 Werner ..... F42B 39/02 224/199

(Continued)

FOREIGN PATENT DOCUMENTS

GB 2489116 A 9/2012

OTHER PUBLICATIONS

International Search Report for Application No. PCT/GB2015/050386, dated May 15, 2015 (Form PCT/ISA/210).

*Primary Examiner* — Joshua E Freeman
(74) *Attorney, Agent, or Firm* — Kilyk & Bowersox, P.L.L.C.

(57) ABSTRACT

A linked round carrying bag having a flexible sleeve and a fastening is provided. The sleeve is sealed at a first end, has an opening at a second end, and has an openable closure, for example, a zip, extending substantially from the first end to the second end. A width of the sleeve is greater than the length of an individual round of the linked round that the bag is designed to carry but is less than twice the length of an individual round. The fastening is adjacent a closed side of an opening of the sleeve and is arranged to be tightly fastenable around the closed side of the opening and any linked round carried in the bag. The fastening can ensure that a linked round is held in its proper position within the bag, even when the bag is carried as a bandolier.

7 Claims, 2 Drawing Sheets

(56) References Cited

U.S. PATENT DOCUMENTS

Figure 1:
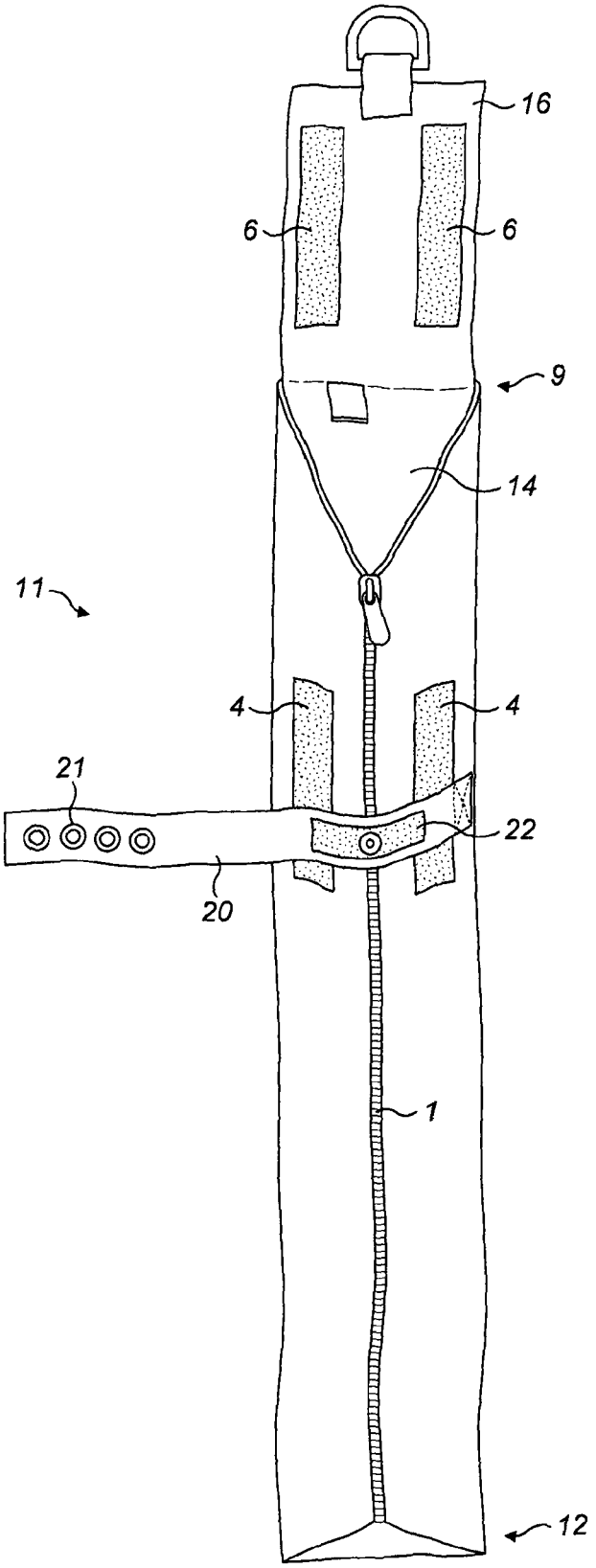

| | | | | | |
|---|---|---|---|---|---|
| 3,127,076 | A * | 3/1964 | Tebbs | A45F 5/02 | 224/199 |
| 3,777,954 | A * | 12/1973 | Theodore | F42B 39/02 | 224/199 |
| 4,265,381 | A * | 5/1981 | Muscatell | A41F 9/002 | 2/312 |
| 4,322,024 | A * | 3/1982 | Kelly | A41F 9/002 | 224/235 |
| D468,904 | S * | 1/2003 | Vazquez | D3/232 | |
| D469,251 | S * | 1/2003 | Vazquez | D3/232 | |
| D469,604 | S * | 2/2003 | Vazquez | D3/232 | |
| 6,675,693 | B1 * | 1/2004 | Heayn | F42B 39/02 | 89/34 |
| 6,799,500 | B1 * | 10/2004 | Kulikowski | F41A 9/79 | 89/1.1 |
| D505,787 | S * | 6/2005 | Vaughn | D3/224 | |
| 7,364,057 | B2 * | 4/2008 | Carroll | A45F 5/02 | 221/309 |
| 8,291,807 | B1 * | 10/2012 | Moody | F41A 9/81 | 89/33.14 |
| 2013/0115393 | A1 * | 5/2013 | Beck | A45F 3/06 | 428/35.2 |
| 2013/0319213 | A1 * | 12/2013 | Simione | F42B 39/26 | 89/34 |
| 2016/0123700 | A1 * | 5/2016 | Manglos | F42B 39/02 | 150/112 |

* cited by examiner

LINKED ROUND CARRYING BAG

FIELD OF THE INVENTION

The present invention relates to the carrying of linked rounds by an individual. In particular, the present invention provides a carrying bag that provides an improved way to carry such rounds.

BACKGROUND

Ammunition for many guns, including machine guns, is provided as linked rounds. Linked rounds are strings of individual rounds (i.e. bullets) that are attached to one another to form a flexible belt. A linked round can be fed through a firearm to provide a continuous supply of bullets and thereby allow continuous fire.

Linked rounds can be used with firearms that are carried by an individual. Primarily due to weight constraints, the typical number of bullets in such a linked round is between 50 and 300 bullets. These linked rounds are currently generally carried in either metal ammunition boxes or square soft pouches. For obvious reasons, metal ammunition boxes are impractical when for use in situations where the user must carry the linked round and have quick access to the linked round when necessary, for example when the user is on patrol. Square soft pouches are also impractical for use on patrol as they must be carried satchel style resulting in the weight of the linked round being centred on a single point of contact. Furthermore, square soft pouches are unsuitable for use when the wearer is carrying a standard patrol pack.

Small linked rounds, which have only 50 to 100 bullets, can be carried in webbing pouches that are normally attached to combat vests, yokes or body armour. However, carrying linked rounds in webbing is not ideal as in order to use a round it is necessary to first completely remove the round from the webbing and lay the round out on the ground. This can lead to dirt or dust impregnating the round.

GB2489116, filed by the current applicant, discloses a linked round carrying bag that provided an improved means for carrying linked rounds. In particular this patent discloses a linked round carrying bag consisting of a flexible sleeve that is sealed at a first end, has an opening at a second end and has an openable closure extending substantially from the first end to the second end, wherein a width of the sleeve is greater than the length of an individual round but is less than twice the length of an individual round.

Through use, some issues have become apparent with the linked round carrying bag of GB2489116. In particular, it has been found that when the bag is not kept horizontal when carried any link rounds stored within the bag can move around within the bag. This can cause the rounds to pool at or near the first end of the bag, away from the opening, thereby making it difficult to access the rounds when a user wishes to do so. This is a particular problem when the bag is carried as a bandolier, which has become the preferred method of carrying the bag.

In light of the above there is a need for an improved linked round carrying bag that solves the problem of the linked rounds pooling at the first end of the bag when the bag is carried.

SUMMARY OF INVENTION

The present invention provides a linked round carrying bag consisting of:

a flexible sleeve that is sealed at a first end, has an opening at a second end and has an openable closure extending substantially from the first end to the second end, wherein a width of the sleeve is greater than the length of an individual round of the linked round but is less than twice the length of an individual round; and a fastening means adjacent a closable side of the opening arranged to be tightly fastenable around the closed side of the opening of the bag and any linked rounds carried in the bag.

The present invention is advantageous over the closest prior art in that it additionally consists of a fastening means that is arranged to be tightly fastenable about the bag and any linked rounds stored in the bag in order to firmly hold the linked rounds in position within the bag. The fastening means is positioned adjacent a closable side of the opening i.e. a side of the opening that can be closed by the openable closure. In particular, the fastening means is positioned such that when it is tightly fastened around the bag and any linked rounds positioned therein it tightly fastens around one of the outermost rounds of the linked rounds to thereby hold the rounds in position adjacent the opening. This can prevent linked rounds carried in the bag from pooling at the first end of the bag when the bag is carried, for example as a bandolier. It can also ensure that the outermost rounds are held adjacent the opening and thus can be immediately accessed by a user when required.

The bag can be used in substantially the same manner as a bag according to the prior art with the addition of using the fastening means to securely hold the linked rounds in position. Specifically, after positioning linked rounds within the bag the fastening means can be tightly fastened about the bag in order to securely hold the rounds in position. When a user desires to access the rounds first the fastening means is unfastened and then the bag can be used in a conventional manner.

It is preferable that fastening means comprises a quick release fastening to allow it to be both quickly fastened and unfastened when required. Suitable quick release fastenings include, but are not limited to, hook and loop fasteners, press studs and snap-fit connectors. A quick release fastening of a fastening means of the present invention may comprise one or more different type of fastenings. For example, a quick release fastening may comprise hook and loop fasteners and press studs.

The fastening means may comprise of any suitable material and may be formed in any manner that is apparent to a person skilled in the art. In a preferred embodiment of the present invention the fastening means comprises a fabric strap that is fixed at a first end to the bag. If the fastening means is formed of fabric then any suitable fabric may be used. In a preferred embodiment of the invention the fastening means is formed of CORDURA® fabric, a trademark of INVISTA.

The bag may be carried in any manner apparent to a person skilled in the art. However, it is anticipated that it will be generally preferable to carry the bag as a bandolier. When it is required to use the linked round, the bag is placed in an appropriate position, the fastening means is opened, the opening at the second end of the sleeve is opened and the end of the linked round is fed into the firearm. After the end of the linked round has been fed into the firearm the firearm can be used without the need to further remove the linked round from the sleeve. This is possible due to the shape of the sleeve and the positioning of the linked round within the sleeve. In particular, as the linked round is fed into the firearm it will be pulled out of the sleeve from the opening.

As all of the bullets in the linked round are parallel to the width of the sleeve and the linked round extends along a length of the sleeve, it can be quickly and easily pulled out of the sleeve without snagging.

A sleeve of a bag according to the present invention may be formed of any suitable material. Advantageously, the sleeve will be formed of fabric. This can allow cheap and easy manufacture whilst providing suitable strength and flexibility. Suitable fabrics will be immediately apparent to the person skilled in the art. In a preferred embodiment of the invention the sleeve is formed from CORDURA® fabric.

The openable closure can be formed in any manner apparent to a person skilled in the art. Advantageously, the openable closure will be able to be opened in a quick and simple manner when it is required to do so but will be resilient enough to prevent accidental opening when the bag is in use. In particular, it is important that the openable closure remains closed when the linked round is being used and thereby being pulled out of the bag from the opening at the second end of the sleeve. In preferred embodiments of the invention, the openable closure consists of a zip.

Alternative closures that may form the openable closure include closures formed by buttons, poppers or hook and loop fastening means. An openable closure of a bag according to the present invention may be formed by one or more of these fastening means. For example, an openable closure may comprise a zip that may be covered by a flap that is secured using hook and loop fastening means. Utilising more than one fastening means to form the openable closure may be advantageous as it can prevent dirt and/or dust entering the bag and can provide the openable closure with added resilience. However, it is to be understood that it is not an essential feature of the invention that the openable closure consists of more than one fastening means.

In order for the operation of the bag to be as simple as possible and in order that the bag is as secure as possible, it may be preferable that the openable closure is positioned substantially centrally along the width of the sleeve. Additionally, it is preferable that the openable closure is substantially straight. Having a straight and centrally positioned openable closure allows the closure to be easily opened when necessary but also allows the closure to be easily hidden when if the bag is folded in half, for example when it is being carried on a standard pack.

The width of the sleeve of a bag according to the present invention is less than twice the length of an individual round of the linked round that is intended to be stored in the bag, when the bag is in use. This prevents a linked round that is stored in the bag from getting tangled and allows the round to be stored in a manner that allows it to be easily slid out of the sleeve from the opening at the second end of the sleeve. Preferably, the width of the sleeve will be less than 150% of the length of an individual round.

In order to allow a linked round to be stored in a sleeve it is necessary that the width of the sleeve is greater than the length of an individual round of the linked round. However, in order to allow a linked round to be easily but securely stored in the bag and to allow it to be easily removed from the opening at the second end of the sleeve when necessary, it is preferable that the width of the sleeve is greater than 120% of the length of an individual round In accordance with the above, in preferred embodiments of the invention the width of the sleeve is approximately 133% of the length of an individual round.

Standard linked rounds consist of a specific number of individual rounds. For example standard linked rounds generally consist of fifty, one hundred or two hundred individual rounds. The number of individual rounds that make up a linked round define the length of the linked round. In preferred embodiments of the invention the length of the bag from the first end to the second end is approximately a quarter of the length of the linked round that the bag carries when in use. That is, if the bag is intended for use with linked rounds that consist of two hundred individual rounds the length of the bag would be approximately the length of fifty individual rounds. This is preferable as it allows the linked round to be folded in the bag to a length that is easy to carry but that still allows the linked round to be pulled from the bag in a simple manner when required. As will be appreciated, bags that are the same length or half the length of the linked round that the bag is intended to be used with may also be preferred.

For any specific bag the volume of the sleeve will be designed to be able to carry a linked round that is folded in the manner intended. For example, if a bag is intended for use with a linked round comprising two hundred individual rounds and is approximately a quarter of the length of that linked round, then the volume of the sleeve will be suitable for containing a two hundred round linked round that has been folded to be a quarter of its total length.

In relation to the length of an individual round it is to be understood that linked rounds come in standard sizes. Each of these standard sizes will consist of a specific number of individual rounds, each of the individual rounds being of a specified length. Any specific bag according to the present invention will be intended to be used with a particular size of linked round and the dimensions of the bag will be determined by the dimensions of the linked round it is intended for use with. For example, a specific bag according to the present invention may be intended for use with a linked round consisting of two hundred individual rounds, each being 68 mm long, and when in use would always be used with a linked round of those dimensions. Different size bags would always be used with the appropriately sized linked rounds. As a result, the definitions of the width and length of a bag according to the present invention must be understood with reference to the specific linked round for which the bag is intended to be used.

The opening at the second end of the sleeve may be left open. However, it is preferably that the bag comprises closure means for openably closing the opening. The closure means may be any suitable means that is apparent to the person skilled in the art. However, it is preferable that the closure means can be opened quickly and in a simple manner when it is necessary to do so. Possible closure means include but are not limited to stud fasteners, hook and loop fastening means, a zip and a drawstring.

In preferred embodiments of the invention the sleeve additionally comprises a closing flap formed at the second end of the sleeve. A closing flap will be formed such that it can be folded over the opening at the second end of the sleeve to close the opening and thereby ensure dirt and dust can not enter the sleeve. A closing flap may be any shape and may be formed in any manner apparent to the person skilled in the art. If the bag comprises a closing flap it is preferable that the closing flap is formed and the fastening means is arranged such that when the closing flap is closed the fastening means can be tightly fastened around the closing flap.

If the sleeve comprises a closing flap then it is advantageous that the bag additionally comprises fastening means for securing the closing flap against an outer surface of the bag. Any suitable fastening means may be used. However, it may be preferable that the sleeve comprises hook and loop fastening means for securing the closing flap against an outer surface of the bag. Hook and loop fastening means are preferred as it allows the closing flap to be securely held in position but also allows the flap to be opened in a quick and simple manner when necessary. If the sleeve comprises a closing flap it is preferable that it is formed such that when folded over it is positioned against the same side of the sleeve as the openable closure and any fastening means for holding the closing flap in position is substantially formed on an inner side of the closing flap and an outer side of the sleeve.

If the bag comprises a closing flap for closing the opening it may be preferable that closing flap has a grab strap attached at an outer end to allow the closing flap to be opened rapidly. Specifically, by including a grab strap it may be possible to open the closing flap simply by pulling on the grab strap. This may be particularly advantageous if the closing flap has fastening means that allow it to be opened by simply pulling firmly on a grab strap, for example if the fastening means is a hook and loop fastening means.

The opening at the second end of the sleeve may be substantially any shape and size that allows the linked round to be pulled out of the bag from the second end of the sleeve in a quick and easy manner. Therefore, as will be understood by a person skilled in the art, the opening should extend substantially across the width of the sleeve. In preferred embodiments of the invention the opening may be substantially triangular or a similar shape and may extend partially along a side of the sleeve. Having the opening extend partially along a side of the sleeve from the first end towards the second end may be preferable as when the opening is opened it allows a user to quickly and easily grasp the end of the linked round. Having the opening extend partially along a side of the sleeve may be particularly preferable if the bag comprises a closing flap, as discussed above.

In order to allow a linked round to be stored in the bag it is necessary for the sleeve to have a substantial volume when filled. That is, the sleeve should not be formed as a completely flat envelope. The sleeve may be formed to have volume in any manner apparent to the person skilled in the art. For example, it may be substantially cuboid when filled. However, in preferred embodiments of the invention the sleeve is formed such that it is substantially a triangular prism, with the openable closure formed along an edge of the prism. This shape, and how it is constructed, is best understood with reference to the preferred embodiment shown in the Figures and discussed below.

In order to allow the bag to be folded in half for carrying it may be preferable that the sleeve comprises fastening means substantially at the first end and/or the second end for securely fastening the first end of the bag to the second end of the bag when the bag is folded in half between the first end and the second end. Preferably the fastening means may comprise comprises a strap and a quick-release buckle. However, the fastening means may additionally or alternatively comprise any other suitable means that is apparent to the person skilled in the art.

In order to allow the bag to be easily carried, whether folded in half in the manner described above or unfolded, the bag may have a carrying handle provided on an outer side. Preferably the outer side will be a side of the flexible sleeve directly opposing the openable closure. A carrying handle may be positioned and formed in any manner apparent to a person skilled in the art. Advantageously, the carrying handle may be a simple strap that is attached at each end to the outer side of the flexible sleeve at an appropriate position.

Additionally or alternatively, the bag may have connecting means at the first end and the second end for allowing the bag to be secured around a person, for example worn in the same manner as a belt, or to be attached to body armour worn by a person. The connecting means at each end may be formed to be connectable to one another or they may be formed to be connectable to connecting means formed on body armour as appropriate. The connecting means may be formed in any manner apparent to a person skilled in the art. In preferred embodiments of the invention the connecting means may be snap-fit connectors.

Further features and advantages of the present invention will be apparent from the preferred embodiment that is shown in the drawings and is discussed below.

DRAWINGS

Figure 2:
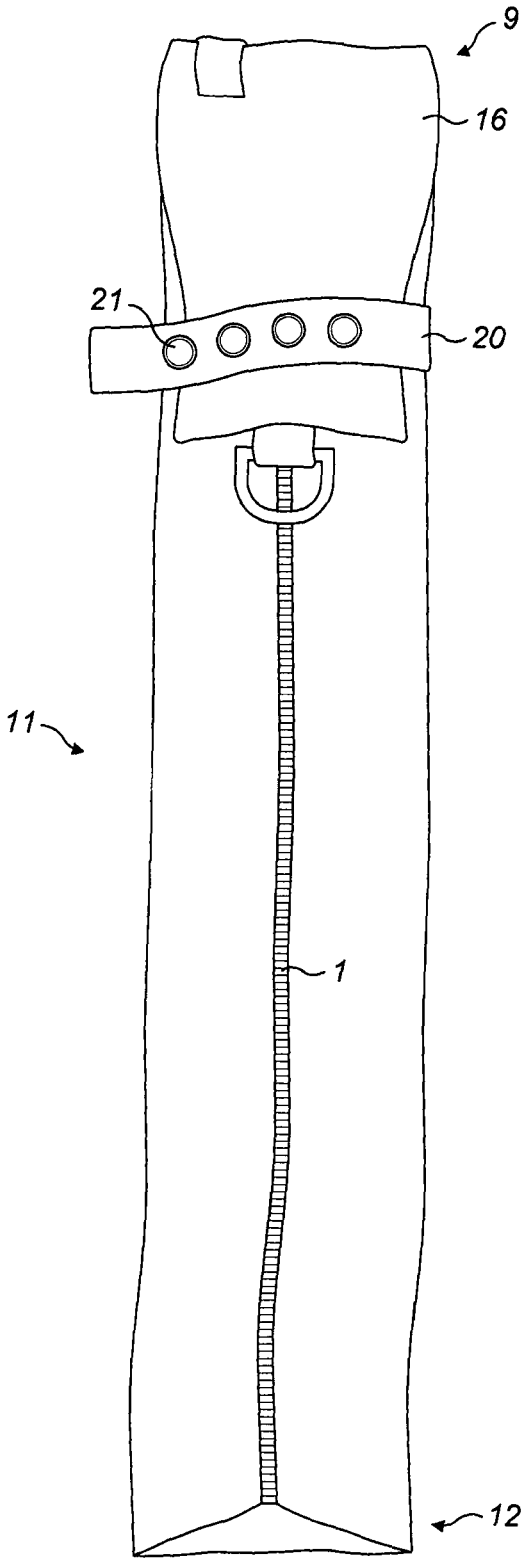

FIG. 1 is a plan view of a bag according to a preferred embodiment of the invention with its fastening means and its closing flap open; and FIG. 2 is a second plan view of the bag of FIG. 1 with the fastening means and the closing flap closed.

A preferred embodiment of a bag 11 according to the present invention is shown in the Figures. The bag 11 consists of a flexible fabric sleeve that is sealed at a first end 12 and open at a second end 9 and a fastening strap 20. The sleeve is formed of CORDURA® fabric. The sleeve has a zip 1 that extends from the first end to an opening 14 at the second end 9. The zip 1 is positioned centrally across a width of the sleeve. The sleeve is formed as a triagonal prism with the zip 1 positioned along one edge of the prism and the opposing face of the prism extending across the width of the sleeve.

The fastening means 20 is a fabric strap that is attached at a first end adjacent the opening 14. The fastening means has a plurality of press studs 21 and a hook and loop fastening 22 that allow it to be tightly fastened around the bag 11, as shown in FIG. 2.

A linked round can be contained within the bag 11. The bag shown in the Figures is intended to hold a linked round (not shown) consisting of two hundred individual rounds that is 3 m long, each individual round has a length of 68 mm. The sleeve has a width of 90 mm and is 750 mm long from the first end 12 to the second end 13. The linked round is intended to be stored within the bag 11 folded over upon itself. In particular, the linked round is intended to be folded so that it is in four layers. The first five to ten individual rounds of the linked round are folded so that they lie on the top of the folded linked round and are at the second end 9 of the sleeve so that the end round can be easily accessed when the bag 11 is opened. When the linked round is being positioned within the bag 11, the bag will be opened using the zip 1 to allow the linked round to be simply placed within the sleeve and folded in the appropriate manner. After the linked round has been placed in the bag 11, the zip 1 will be closed and need not be reopened until a new linked round is required to be positioned within the bag. It is not necessary to open the zip 1 to remove the linked round 5 from the bag 11.

The second end 9 of the bag 11 is closed by a closing flap 16. The flap 16 can be folded back over the bag and secured against an outer surface of the sleeve using hook and loop fastening means 4, 6 positioned on the outer surface of the sleeve and an inner side of the flap 16 respectively. When folded over, the flap 16 covers the end of the zip 1. This prevents the zip 1 being inadvertently opened. After a linked round has been appropriately positioned in the bag 11 the closing flap 16 is closed and the fastening strap 20 is tightly fastened around the closing flap 16 and the linked rounds. This holds the outermost rounds of the linked rounds in position no matter how the bag 11 is held. Advantageously it ensures that the outermost rounds are immediately accessible and positioned at the opening 14 when the flap is opened 16.

The opening 14 at the second end of the bag 11 is triangular in shape. This shape is particularly advantageous as, in conjunction with the correct folding of the linked round positioned within the bag 11, it allows the linked round to be rapidly removed from the bag.

When it is necessary to use the bag 11, the fastening 20 will be undone, the flap 16 will be opened. When the flap 16 has been opened the triangular shape of the opening 1 then reveals the end of the linked round, which is immediately visible and accessible. The end of the linked round can then be fed into the appropriate firearm. As the linked round is fed through the firearm it will be gradually pulled out of the bag 11. It is not necessary for the linked round to be completely removed from the bag 1 before being used. However, if it is desirable to do this it can be done in a simple and quick manner by simply pulling the end of the linked round out of the bag 11.

The invention claimed is:

1. A linked round carrying bag, comprising:

a flexible sleeve comprising a sealed first end, an open second end defining an opening, and an openable closure extending substantially from the first end to the second end, wherein a width of the sleeve is greater than the length of an individual round of a linked round to be carried in the bag but is less than twice the length of an individual round;

a closing flap at the second end, attached to the flexible sleeve, having a free edge, and configured to flap down over the opening to close the opening; and a fastening strap fixed to the flexible sleeve adjacent the opening at the second end, positioned on the flexible sleeve closer to the second end than is the free edge of the closing flap when the closing flap is flapped down over the opening to close the opening, the fastening strap having a length and being arranged to extend around the flexible sleeve, around any linked rounds carried in the flexible sleeve, and around the closing flap to thereby hold the linked rounds in position adjacent the opening when the bag is carried as a bandolier.

2. A bag according to claim 1, wherein the fastening strap comprises a quick release fastening.

3. A bag according to claim 2, wherein the quick release fastening comprises a hook and loop fastener.

4. A bag according to claim 2, wherein the quick release fastening comprises press studs.

5. A bag according to claim 1, wherein the fastening strap comprises a fabric strap.

6. In combination, the linked round carry bag of claim 1 and a linked round held therein, the link round comprising a plurality of individual rounds, each individual round of the plurality having a length, wherein the width of the sleeve is greater than 120% of the length of each individual round and less than 150% of the length of each individual round.

7. A method of using a linked round carrying bag, the bag comprising:

a flexible sleeve comprising a sealed first end, an open second end defining an opening, and an openable closure extending substantially from the first end to the second end, wherein the width of the sleeve is greater than the length of an individual round of a linked round to be carried in the bag but is less than twice the length of an individual round;

a closing flap at the second end, attached to the flexible sleeve, having a free edge, and configured to flap down over the opening to close the opening; and a fastening strap fixed to the flexible sleeve adjacent the opening at the second end, positioned on the flexible sleeve closer to the second end than is the free edge of the closing flap when the closing flap is flapped down over the opening to close the opening, the fastening strap having a length and being arranged to extend around the flexible sleeve, around any linked rounds carried in the flexible sleeve, and around the closing flap to thereby hold the linked rounds in position adjacent the opening;

the method comprising the steps of:

positioning a linked round in the bag such that the linked round is folded over upon itself;

closing the openable closure to contain the linked round in the bag;

wrapping the fastening strap completely around the flexible sleeve, around the linked round in the bag, and around the closing flap;

tightly fastening the fastening strap to thereby hold the linked round in position adjacent the opening; and carrying the bag as a bandolier.

* * * * *